US010292907B2

(12) United States Patent
Huang

(10) Patent No.: US 10,292,907 B2
(45) Date of Patent: May 21, 2019

(54) SMART MEDICINE BOX

(71) Applicant: Wenjia Huang, Zhejiang (CN)

(72) Inventor: Wenjia Huang, Zhejiang (CN)

( * ) Notice: Subject to any disclaimer, the term of this patent is extended or adjusted under 35 U.S.C. 154(b) by 0 days.

(21) Appl. No.: 16/031,322

(22) Filed: Jul. 10, 2018

(65) Prior Publication Data

US 2018/0318175 A1 Nov. 8, 2018

Related U.S. Application Data

(63) Continuation of application No. PCT/CN2017/070722, filed on Jan. 10, 2017.

(30) Foreign Application Priority Data

Jan. 13, 2016 (CN) ..... 2016 1 0019625

(51) Int. Cl.
*A61J 7/04* (2006.01)
*A61J 7/00* (2006.01)

(52) U.S. Cl.
CPC ..... *A61J 7/0481* (2013.01); *A61J 7/0076* (2013.01); *A61J 7/04* (2013.01); *A61J 7/0436* (2015.05);

(Continued)

(58) Field of Classification Search
CPC ..... A61J 2200/30; A61J 2205/10–2205/50
See application file for complete search history.

(56) References Cited

U.S. PATENT DOCUMENTS 4,573,606 A 3/1986 Lewis et al.
5,176,285 A * 1/1993 Shaw ..... A61J 7/0084 221/113

(Continued)

FOREIGN PATENT DOCUMENTS

CN 1541898 A 11/2004
CN 1622838 A 6/2005

(Continued)

OTHER PUBLICATIONS

International Search Report for PCT Application No. PCT/CN2017/070722; State Intellectual Property Office of the P.R. China; Beijing, China; dated Apr. 10, 2017.

(Continued)

*Primary Examiner* — Gene O Crawford
*Assistant Examiner* — Ayodeji T Ojofeitimi
(74) *Attorney, Agent, or Firm* — Thomas E. Lees, LLC

(57) ABSTRACT

This invention discloses a smart medicine box, comprising a box body and a cover body attached to an upper portion of the box body, wherein the box body is provided with continuous medicine bags for use with the same. The continuous medicine bags are connected with one another in a point break manner. The box body is provided with a medicine taking port at one side thereof. The cover body is provided with a detection head, a PCB board and a power source, and the detection head is close to the side of the medicine taking port on the box body. The medicine bag is provided with a detection zone to cooperate with the detection head. The smart medicine box has the following advantages: medicine bag tracking can be implemented according to a predetermined medication plan by means of encapsulating medicines taken by the patient each time.

6 Claims, 4 Drawing Sheets

(52) U.S. Cl.
CPC ..... *A61J 7/0445* (2015.05); *A61J 7/0454* (2015.05); *A61J 2205/60* (2013.01)

(56) References Cited

U.S. PATENT DOCUMENTS

| | | | | |
|---|---|---|---|---|
| 6,330,957 | B1 | 12/2001 | Bell-Greenstreet | |
| 2008/0290106 | A1* | 11/2008 | van der Klaauw ... | A61J 7/0076 221/1 |
| 2013/0175286 | A1* | 7/2013 | Barrett ..... | A61J 1/035 221/1 |
| 2015/0332536 | A1* | 11/2015 | Dial, III ..... | A01K 29/00 221/1 |

FOREIGN PATENT DOCUMENTS

| | | | |
|---|---|---|---|
| CN | 103315909 | A | 9/2013 |
| CN | 105129306 | A | 12/2015 |
| CN | 105460399 | A | 4/2016 |
| CN | 205293624 | U | 6/2016 |

OTHER PUBLICATIONS

Written Opinion of the International Searching Authority for PCT Application No. PCT/CN2017/070722; State Intellectual Property Office of the P.R. China; Beijing, China; dated Apr. 11, 2017.
International Preliminary Report on Patentability and Written Opinion of the International Searching Authority for PCT Application No. PCT/CN2017/070722; The International Bureau of WIPO; Geneva, Switzerland; dated Jul. 17, 2018.

* cited by examiner

SMART MEDICINE BOX

CROSS REFERENCE TO RELATED APPLICATIONS

This is a Continuation application of International Application Serial No. PCT/CN2017/070722, filed on Jan. 10, 2017, which claims the benefit of Chinese Application No. 201610019625.1, filed on Jan. 13, 2016, the disclosures of which are hereby incorporated by reference.

BACKGROUND

The present disclosure relates to a medicine box, and in particular, to a smart medicine box for tracking medicine bags according to a predetermined medication plan.

At present, there are many types of smart medicine boxes on the market, which can be roughly classified into two categories as follows. One is that a patient can only manually fill medicines to be taken into a medicine box, and recording is made while the medicine box is opened. During the filling process, the patient is very prone to errors, resulting in serious accidents such as taking medicines in error. At the same time, the patient's own workload is very large and it is inconvenient for consumers to use. Moreover, such a medicine box can only detect whether a medicine box has been opened or not, and it cannot determine whether a patient has taken all the medicines in the box which are necessary to be taken, so the intelligent data provided is very inaccurate. Another category of smart medicine boxes can monitor the opening of a medicine box in the form of a bottle. A disadvantage thereof is that if a user needs to take multiple kinds of medicines, a corresponding number of smart medicine boxes will be imperative. When taking medicines, it is necessary to open multiple medicine boxes in turn. In fact, the workload of a user does not decrease. Instead, it is more troublesome for the user. Secondly, such types of medicine boxes cannot track the usage of medicines packaged in other ways. Furthermore, such types of medicine boxes also cannot determine how many pills the patient has taken out from each bottle. Actually, the provided intelligent data cannot be used medically. Moreover, for the reason that there are medicine bottles of different specifications, in order to adapt to bottle mouths of different specifications, corresponding medicine boxes is necessary to provided. Thus, the medicine boxes cannot be standardized, and the manufacturing costs and the usage cost for a patient are very high.

BRIEF SUMMARY

The technical problem to be solved by the present invention is to provide a smart medicine box for performing medicine bag tracking according to a predetermined medication plan by means of encapsulating medicines to be taken by a patient each time.

In order to solve the above technical problem, the present invention provides a smart medicine box comprising a box body and a cover body attached to an upper portion of the box body. The box body is provided with continuous medicine bags therein for use therewith, the medicine bags are connected with one another in a point-break manner. The box body is provided with a medicine taking port at one side thereof. The cover body is provided with a detection head, a PCB (printed circuit board) and a power source. The detection head is positioned close to a side of the medicine taking port on the box body. Each medicine bag is provided with a detection zone to cooperate with the detection head. Before the continuous medicine bags are put into the medicine box, a medical technician will put certain quantities and kinds of medicines to be taken each time into each medicine bag and package the bags in order to facilitate the patient to take the medicines.

Preferably, a support plate supporting the continuous medicine bags is disposed in the box body.

Preferably, the detection head is an optical detection head.

Preferably, the detection zone is a through hole, and the support plate is provided with a receiver to cooperate with the optical detection head.

Preferably, the detection zone is a through hole, and a receiver for use with the optical detection head is disposed on the cover body, and the support plate is provided with a reflective layer to cooperate with the optical detection head and the receiver.

Preferably, a sealing portion of the medicine bag includes a transparent area and a coating area, the transparent area is the detection zone, and the support plate is provided with a receiver to cooperate with the optical detection head.

Preferably, a sealing portion of the medicine bag includes a transparent area and a coating area, the transparent area is the detection zone, and a receiver to cooperate with the optical detection head is disposed on the cover body, and the support plate is provided with a reflective layer to cooperate with the optical detection head and the receiver.

Preferably, a sealing portion of the medicine bag includes a transparent area and a coating area, the coating area is the detection zone, and the support plate is provided with a receiver to cooperate with the optical detection head.

Preferably, the detection head is a contactless reader.

Preferably, the detection zone is a contactless tag.

With the above structure, the smart medicine box of the present disclosure has the following advantages as compared with the prior art:

1. Patients do not need to classify drugs themselves.
2. No matter how many medicines are taken at the same time, the patient only needs to take out the corresponding one bag. Memorization, additional workload and multiple equipments are not required.
3. The medicine bags are arranged in the order of serving sequence, thus the patient do not need to memorize what time to take the medicines and what medicines should be taken. Instead, the patient only needs to take a bag in turn.
4. The medicine bags are connected continuously, thus, disorder in serving sequence will not occur.
5. The smart medicine box allows accurate determination of the amount of medicines taken by a patient and the time at which the medicines were taken, by means of monitoring the medicine bags that have been taken.
6. No matter how many medicines are to be taken by a patient at one time, only one smart medicine box is necessary, thus the manufacturing cost and the usage cost for a patient is very low.

LIST OF REFERENCE NUMERALS

| | | |
|---|---|---|
| 1~box body | 2~cover body | 3~medicine bag |
| 4~medicine taking port | 5~detection head | 6~PCB board |
| 7~power source | 8~detection zone | 9~support plate. |

DETAILED DESCRIPTION

The embodiments of the invention will be described in detail by incorporating of examples with reference to the accompanying drawings.

Figure 1:
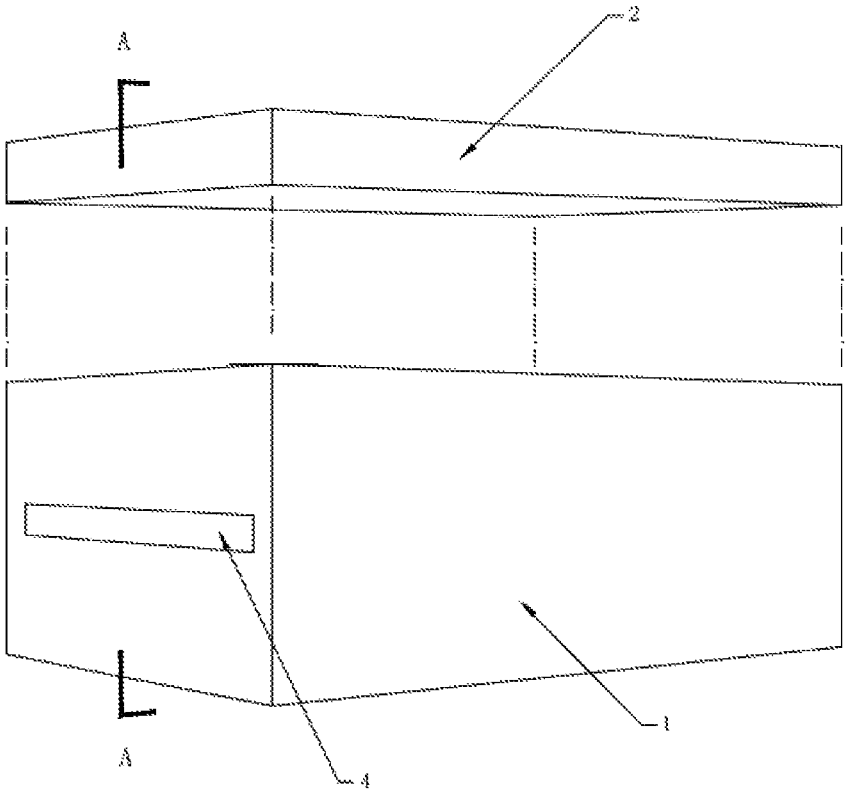
FIG. 1 is a schematic structural view of a smart medicine box according to an embodiment of the present invention.
Figure 2:
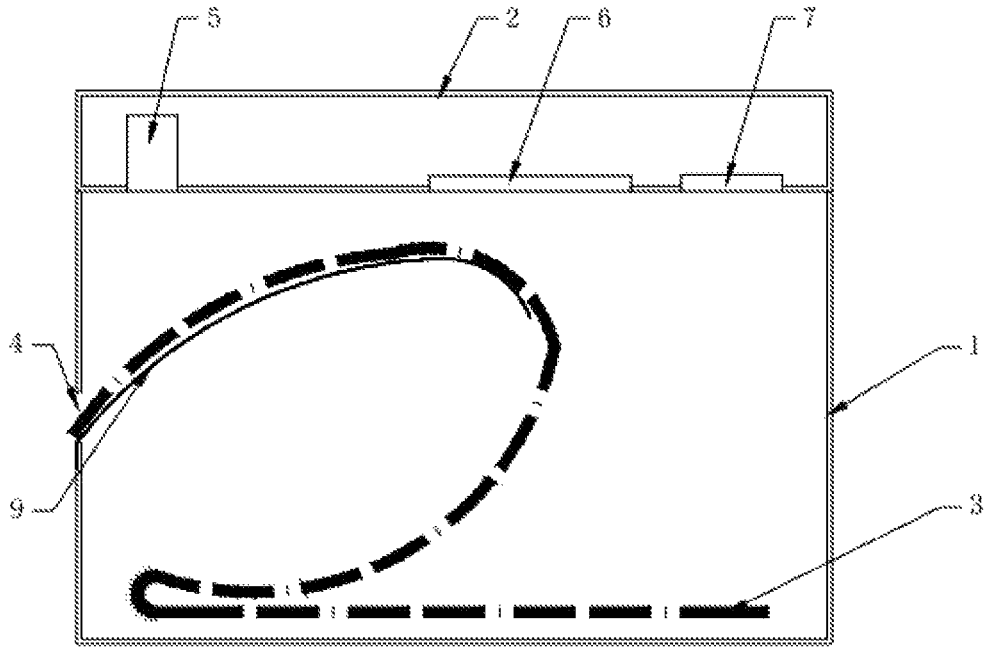
FIG. 2 is a cross-sectional view showing the smart medicine box of FIG. 1 taken along line A-A.

As shown in FIG. 1 to FIG. 2, a smart medicine box provided in this embodiment comprises a box body 1 and a cover body 2 attached to an upper portion of the box body 1. The box body 1 is provided with continuous medicine bags 3 therein for use therewith. The continuous medicine bags 3 are connected with one another in a point-break manner. The box body 1 is provided with a medicine taking port 4 at one side thereof. The cover body 2 is provided with a detection head 5, a PCB board 6 and a power source 7. The PCB board 6 serves as a control terminal and a communication terminal for transmitting data to a server port. The detection head 5 is positioned close to the side of the medicine taking port 4 on the box body 1, and the medicine bag 3 is provided with a detection zone 8 to cooperate with the detection head 5. A support plate 9 supporting the continuous medicine bags 3 is disposed in the box body 1.

Figure 3:
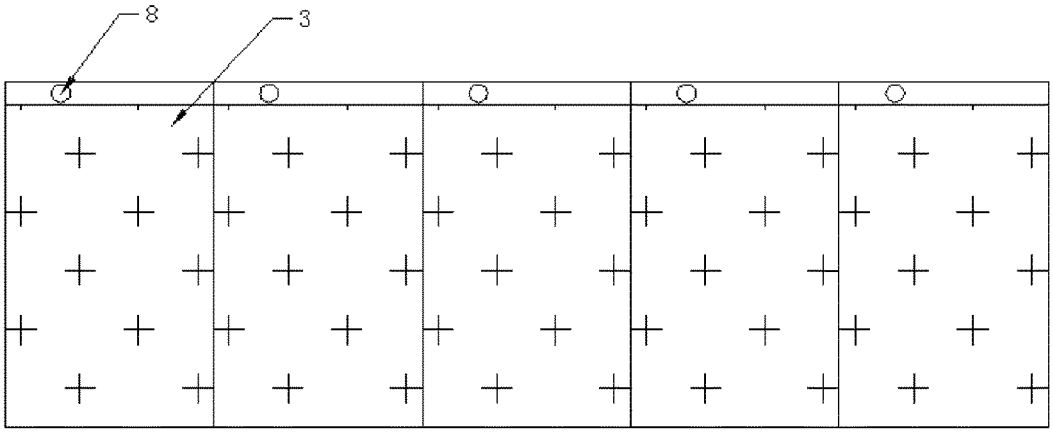
FIG. 3 is the first schematic view of the medicine bags according to an embodiment of the present invention.

As shown in FIG. 3, the detection head 5 is an optical detection head, the detection zone 8 is a through hole, and the support plate 9 is provided with a receiver which cooperates with the optical detection head. A beam from the optical detection head passes through the through hole and is received by the receiver. This process is counted once, indicating that the patient has taken a medicine bag away, the rest process can be done in the same manner.

As shown in FIG. 3, the detection head 5 is an optical detection head, the detecting zone 8 is a through hole, and a receiver to cooperate with the optical detection head is disposed on the cover body 2, and the support plate 9 is provided with a reflective layer to cooperate with the optical detection head and the receiver. A light beam of the optical detection head passes through the through hole and is reflected to the receiver by the reflective layer. When the receiver receives the beam, it is counted once, indicating that the patient has taken a medicine bag away.

Figure 4:
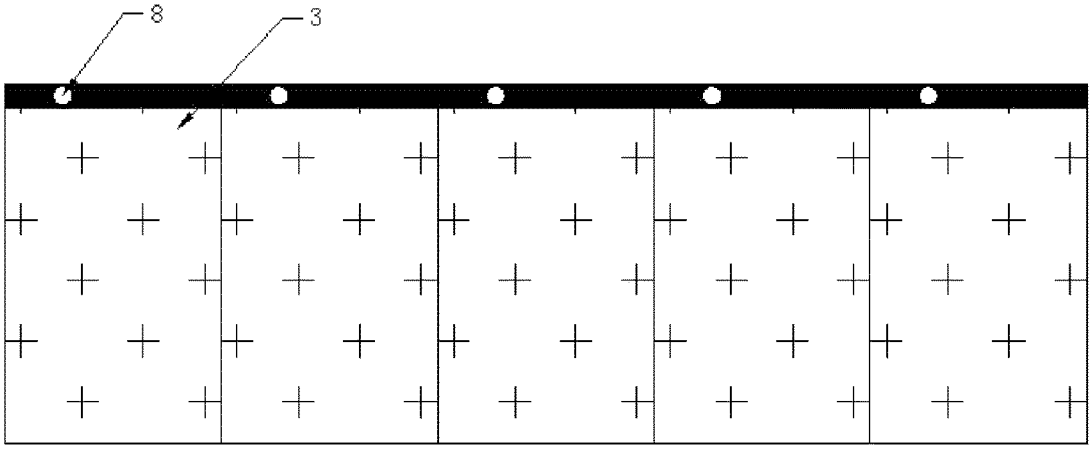
FIG. 4 is the second schematic view of the medicine bags according to an embodiment of the present invention.

As shown in FIG. 4, the detection head 5 is an optical detection head. A sealing portion of the medicine bag 3 includes a transparent area and a coating area. The transparent area is the detecting zone 8, and the support plate 9 is provided with a receiver to cooperate with the optical detection head. A beam of the optical detection head passes through the transparent area and then is received by the receiver. This process is counted once, indicating that the patient has taken a bag away.

As shown in FIG. 4, the detection head 5 is an optical detection head, and a sealing portion of the medicine bag 3 includes a transparent area and a coating area. The transparent area is the detecting zone 8. A receiver cooperating with the optical detection head is provided on the cover body 2. The support plate 9 is provided with a reflective layer to cooperate with the optical detection head and the receiver. A light beam of the optical detection head passes through the transparent area and is reflected to the receiver by the reflective layer. When the receiver receives the beam, it is counted once, indicating that the patient has taken a medicine bag away.

Figure 5:
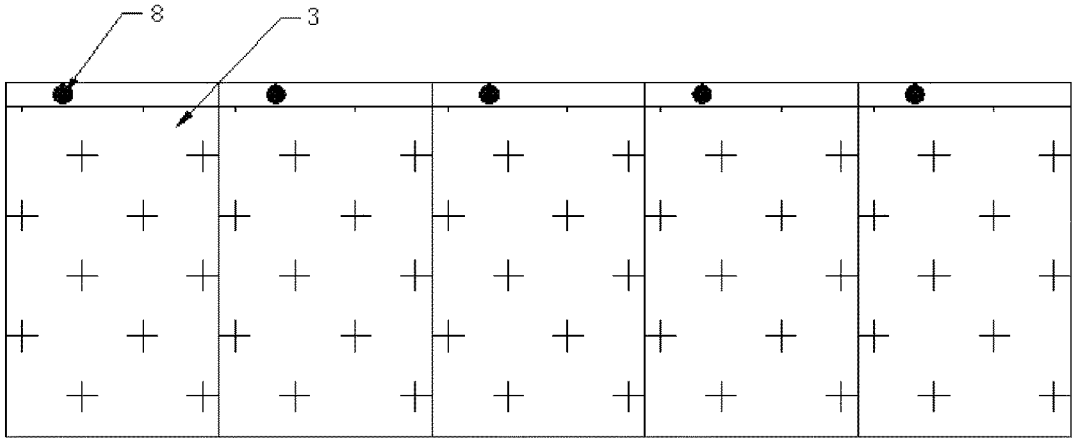
FIG. 5 is the third schematic view of the medicine bags according to an embodiment of the present invention.

As shown in FIG. 5, the detection head 5 is an optical detection head, and a sealing portion of the medicine bag 3 includes a transparent area and a coating area. The coating area is the detecting zone 8. The support plate 9 is provided with a receiver to cooperate with the optical detection head. The receiver can receive signals continuously during the process of extracting the medicine bags. When a light beam from the optical detection head passes the coating area, the receiver receives no signal, indicating that a medicine bag has been removed, and meaning the patient has taken the medicine bag away.

Figure 6:
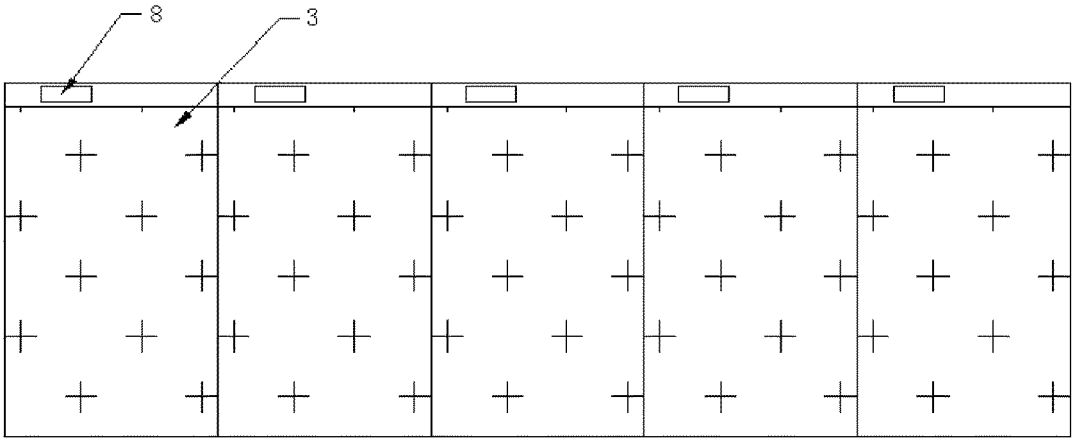
FIG. 6 is the fourth schematic view of the medicine bags according to an embodiment of the present invention.

As shown in FIG. 6, the detection head 5 is a contactless reader, such as a wireless RF (radio frequency) identification reader, a magnetic card reader, an IC (integrated circuit) card reader, and the like. The detection zone is a contactless tag, such as a wireless RF tag, a magnetic card, an IC card, and the like. Once the wireless RF identification reader receives a signal, it indicates that a medicine bag has been taken away.

As to the specific operating mode, by use of an automatic medicine dispensing machine, manual or other means, all the medicines to be taken by a patient are packaged separately according to the time sequence as well as the specific medicines to be taken each time. The packaged medicine bags are put into the smart medicine box according to the embodiments of present invention. The patient takes a bag of medicine from the medicine taking port each time, tears it, opens it and takes the medicines in it. The smart medicine box uses the optical detection head or wireless RF identification reader and the like, to detect a tracking sign on the medicine bag so as to determine that a medicine bag has been taken away, and records the time at which the bag was taken. The information recorded by the smart medicine box is periodically sent to a server for data recording, through a communication module such as GPRS (general packet radio service)/Wifi/Bluetooth/Zigbee/RFID (radio frequency identification) and the like.

What is claimed is:

1. A smart medicine box comprising:

a box body; and a cover body attached to an upper portion of the box body, wherein:

the box body is provided with continuous medicine bags therein for use therewith, and the continuous medicine bags are connected with one another in a point-break manner;

the box body is provided with a medicine taking port at one side thereof;

the cover body is provided with a detection head, a PCB board and a power source;

the detection head is positioned close to the side of the medicine taking port on the box body;

each medicine bag is provided with a detection zone to cooperate with the detection;

a support plate supporting the continuous medicine bags is disposed in the box body;

the detection head is an optical detection head; and the detection zone is a through hole, and a receiver to cooperate with the optical detection head is disposed on the cover body, and the support plate is provided with a reflective layer to cooperate with the optical detection head, and the receiver.

2. A smart medicine box comprising:

a box body; and a cover body attached to an upper portion of the box body, wherein:

the box body is provided with continuous medicine bags therein for use therewith, and the continuous medicine bags are connected with one another in a point-break manner;

the box body is provided with a medicine taking port at one side thereof;

the cover body is provided with a detection head, a PCB board and a power source;

the detection head is positioned close to the side of the medicine taking port on the box body;

each medicine bag is provided with a detection zone to cooperate with the detection;

a support plate supporting the continuous medicine bags is disposed in the box body;

the detection head is an optical detection head; and a sealing portion of the medicine bag includes a transparent area and a coating area, the transparent area is the detection zone, and the support plate is provided with a receiver to cooperate with the optical detection head.

3. A smart medicine box comprising:

a box body; and a cover body attached to an upper portion of the box body, wherein:

the box body is provided with continuous medicine bags therein for use therewith, and the continuous medicine bags are connected with one another in a point-break manner;

the box body is provided with a medicine taking port at one side thereof;

the cover body is provided with a detection head, a PCB board and a power source;

the detection head is positioned close to the side of the medicine taking port on the box body;

each medicine bag is provided with a detection zone to cooperate with the detection;

a support plate supporting the continuous medicine bags is disposed in the box body;

the detection head is an optical detection head; and a sealing portion of the medicine bag includes a transparent area and a coating area, the transparent area is the detection zone, and a receiver which cooperates with the optical detection head is disposed on the cover body, and the support plate is provided with a reflective layer to cooperate with the optical detection head and the receiver.

4. A smart medicine box comprising:

a box body; and a cover body attached to an upper portion of the box body, wherein:

the box body is provided with continuous medicine bags therein for use therewith, and the continuous medicine bags are connected with one another in a point-break manner;

the box body is provided with a medicine taking port at one side thereof;

the cover body is provided with a detection head, a PCB board and a power source;

the detection head is positioned close to the side of the medicine taking port on the box body;

each medicine bag is provided with a detection zone to cooperate with the detection;

a support plate supporting the continuous medicine bags is disposed in the box body;

the detection head is an optical detection head; and a sealing portion of the medicine bag includes a transparent area and a coating area, the coating area is the detection zone, and the support plate is provided with a receiver to cooperate with the optical detection head.

5. A smart medicine box comprising:

a box body; and a cover body attached to an upper portion of the box body, wherein:

the box body is provided with continuous medicine bags therein for use therewith, and the continuous medicine bags are connected with one another in a point-break manner;

the box body is provided with a medicine taking port at one side thereof;

the cover body is provided with a detection head, a PCB board and a power source;

the detection head is positioned close to the side of the medicine taking port on the box body;

each medicine bag is provided with a detection zone to cooperate with the detection;

a support plate supporting the continuous medicine bags is disposed in the box body;

the detection head is a contactless reader; and a sealing portion of the medicine bag includes a transparent area and a coating area, the transparent area is the detection zone, and a receiver which cooperates with the contactless reader is disposed on the cover body, and the support plate is provided with a reflective layer to cooperate with the contactless reader and the receiver.

6. The smart medicine box according to claim 5, wherein: the detection zone is a contactless tag.

* * * * *